US010741010B2

(12) United States Patent
Larsen et al.

(10) Patent No.: US 10,741,010 B2
(45) Date of Patent: Aug. 11, 2020

(54) ELECTRONIC GAMING SYSTEM AND METHOD PROVIDING PLAYER TACTILE FEEDBACK BASED ON PLAYER EYE GAZE DATA

(71) Applicant: IGT, Las Vegas, NV (US)

(72) Inventors: Kurt Larsen, Reno, NV (US); Marcus Schwendener, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/211,781

(22) Filed: Dec. 6, 2018

(65) Prior Publication Data

US 2020/0184761 A1 Jun. 11, 2020

(51) Int. Cl.
*G07F 17/32* (2006.01)

(52) U.S. Cl.
CPC ..... *G07F 17/3211* (2013.01); *G07F 17/3206* (2013.01); *G07F 17/3216* (2013.01); *G07F 17/3223* (2013.01)

(58) Field of Classification Search
None
See application file for complete search history.

(56) References Cited

U.S. PATENT DOCUMENTS

| | | | | |
|---|---|---|---|---|
| 5,326,104 | A | 7/1994 | Pease et al. | |
| 9,058,714 | B2 | 6/2015 | Hamlin et al. | |
| 9,076,306 | B2 | 7/2015 | Beaulieu et al. | |
| 9,691,219 | B1 | 6/2017 | Froy et al. | |
| 9,710,996 | B2 | 7/2017 | Keilwert et al. | |
| 10,089,827 | B2 | 10/2018 | Froy et al. | |
| 10,235,827 | B2 * | 3/2019 | Gagner | G07F 17/32 |
| 2006/0199645 | A1 * | 9/2006 | Canterbury | G07F 17/32 463/43 |
| 2012/0115589 | A1 | 5/2012 | Canterbury et al. | |
| 2012/0302323 | A1 | 11/2012 | Gagner et al. | |
| 2013/0296053 | A1 * | 11/2013 | Rasmussen | G07F 17/32 463/31 |
| 2016/0175701 | A1 | 6/2016 | Froy et al. | |
| 2016/0180636 | A1 | 6/2016 | David et al. | |
| 2017/0165566 | A1 | 6/2017 | Froy | |
| 2017/0169649 | A1 | 6/2017 | Froy et al. | |
| 2017/0169651 | A1 | 6/2017 | Froy et al. | |
| 2017/0169658 | A1 | 6/2017 | Froy et al. | |
| 2017/0169659 | A1 | 6/2017 | Froy | |
| 2017/0169663 | A1 | 6/2017 | Froy | |
| 2017/0236363 | A1 * | 8/2017 | Froy | G07F 17/3209 463/25 |
| 2018/0040190 | A1 | 2/2018 | Keilwert et al. | |
| 2018/0078854 | A1 | 3/2018 | Achmueller et al. | |
| 2018/0130293 | A1 | 5/2018 | Froy et al. | |
| 2018/0365928 | A1 | 12/2018 | Froy et al. | |

FOREIGN PATENT DOCUMENTS

WO WO 2006/015335 A1 2/2006

* cited by examiner

*Primary Examiner* — Jay Trent Liddle
*Assistant Examiner* — Alex F. R. P. Rada, II
(74) *Attorney, Agent, or Firm* — Neal, Gerber & Eisenberg LLP

(57) ABSTRACT

A gaming system including an electronic gaming machine and an associated player chair configured to operate with the electronic gaming machine to provide player tactile feedback based on player eye gaze data, and thus provide enhanced physical player interaction.

20 Claims, 9 Drawing Sheets

1000

ELECTRONIC GAMING SYSTEM AND METHOD PROVIDING PLAYER TACTILE FEEDBACK BASED ON PLAYER EYE GAZE DATA

BACKGROUND

The present disclosure relates to gaming systems, and more particularly electronic gaming machines that enable play of wagering games. Electronic gaming machines may include one or more primary wagering games. Electronic gaming machines may also include one or more secondary games (such as one or more bonus games).

BRIEF SUMMARY

Various embodiments of the gaming systems and methods of the present disclosure provide an electronic gaming machine and an associated player chair configured to operate with the electronic gaming machine to provide player tactile feedback based on player eye gaze data obtained by the electronic gaming machine, and thus provide enhanced physical player interaction.

Various embodiments of the present disclosure provide a gaming system including: a player chair including a player tactile feedback provider; and an electronic gaming machine associated with the player chair. The electronic gaming machine includes a player eye tracker, a processor, and a memory device storing a plurality of instructions, which when executed by the processor, cause the processor to operate with: the player eye tracker to determine whether a player has selected a selectable object using the player's eyes, and responsive to the determination that the player has selected the selectable object using the player's eyes, cause the player tactile feedback provider to provide a tactile feedback to the player.

Various embodiments of the present disclosure provide a gaming system including a player chair including a player tactile feedback provider including a transducer; and an electronic gaming machine associated with the player chair. The electronic gaming machine includes a display device, a player eye tracker, a processor, and a memory device storing a plurality of instructions, which when executed by the processor, cause the processor to operate with: the display device to display a selectable 3D object as part of a play of a game, the player eye tracker to determine whether a player has selected the selectable 3D object using the player's eyes, and responsive to the determination that the player has selected the selectable 3D object using the player's eyes, cause the player tactile feedback provider to provide a tactile feedback to the player as an acknowledgement of the player's selection of the selectable 3D object using the player's eyes within a designated period of time after the player's selection of the selectable 3D object using the player's eyes.

Various embodiments of the present disclosure provide a method of operating a gaming system including an electronic gaming machine and a player chair. The method includes causing the electronic gaming machine to display a plurality of selectable 3D images, determining, by a player eye tracker, whether a player has selected one of the displayed selectable 3D images using the player's eyes, and responsive to the determination that the player has selected one of the displayed selectable 3D images using the player's eyes, cause a player tactile feedback provider of the player chair to provide a tactile feedback to the player based on that selected 3D image.

Additional features are described in, and will be apparent from, the following Detailed Description and the Figures.

DETAILED DESCRIPTION

Figure 1:
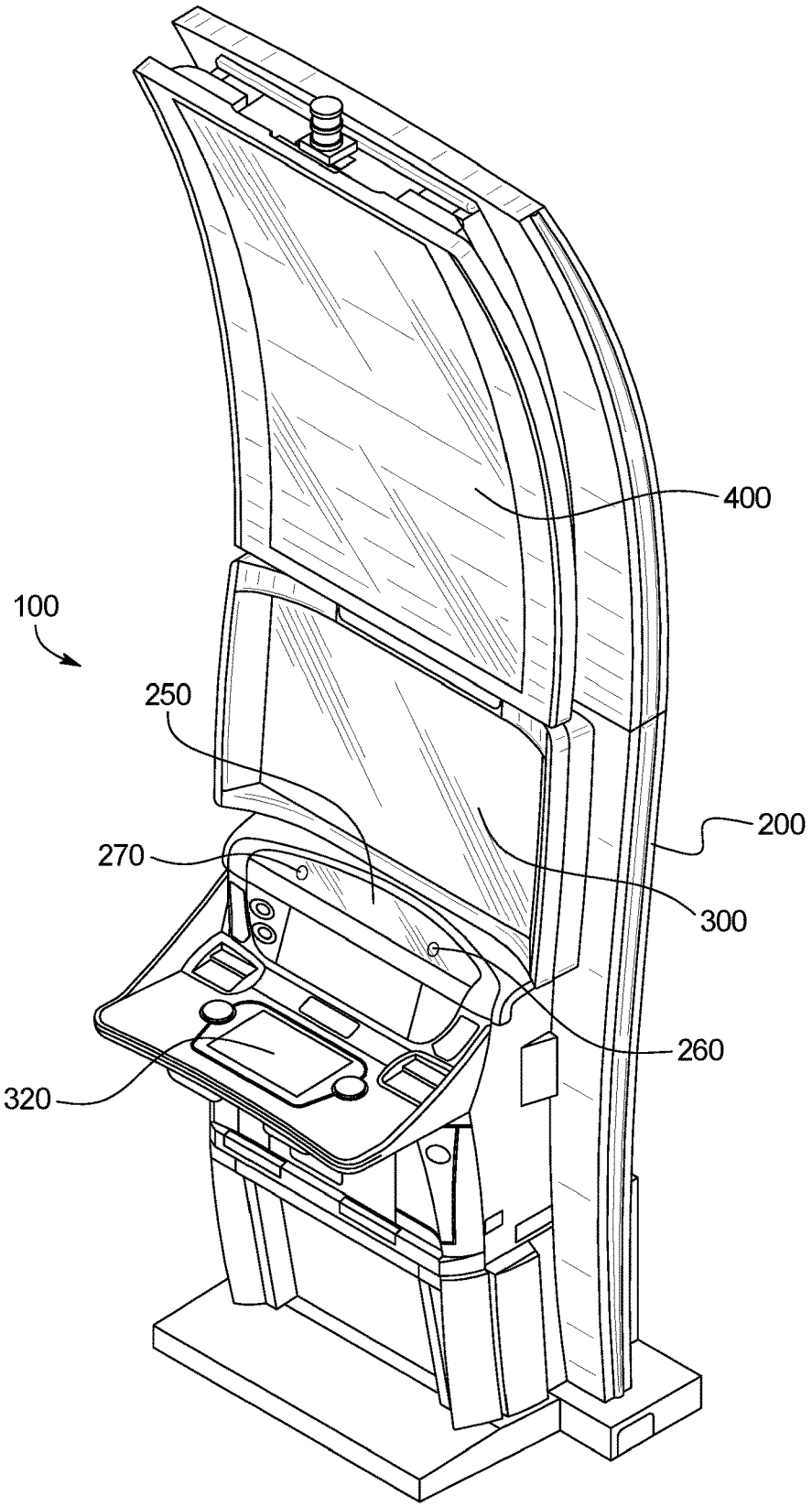
FIG. 1 is a front perspective view of one example embodiment of an electronic gaming machine of the gaming system of the present disclosure.
Figure 2:
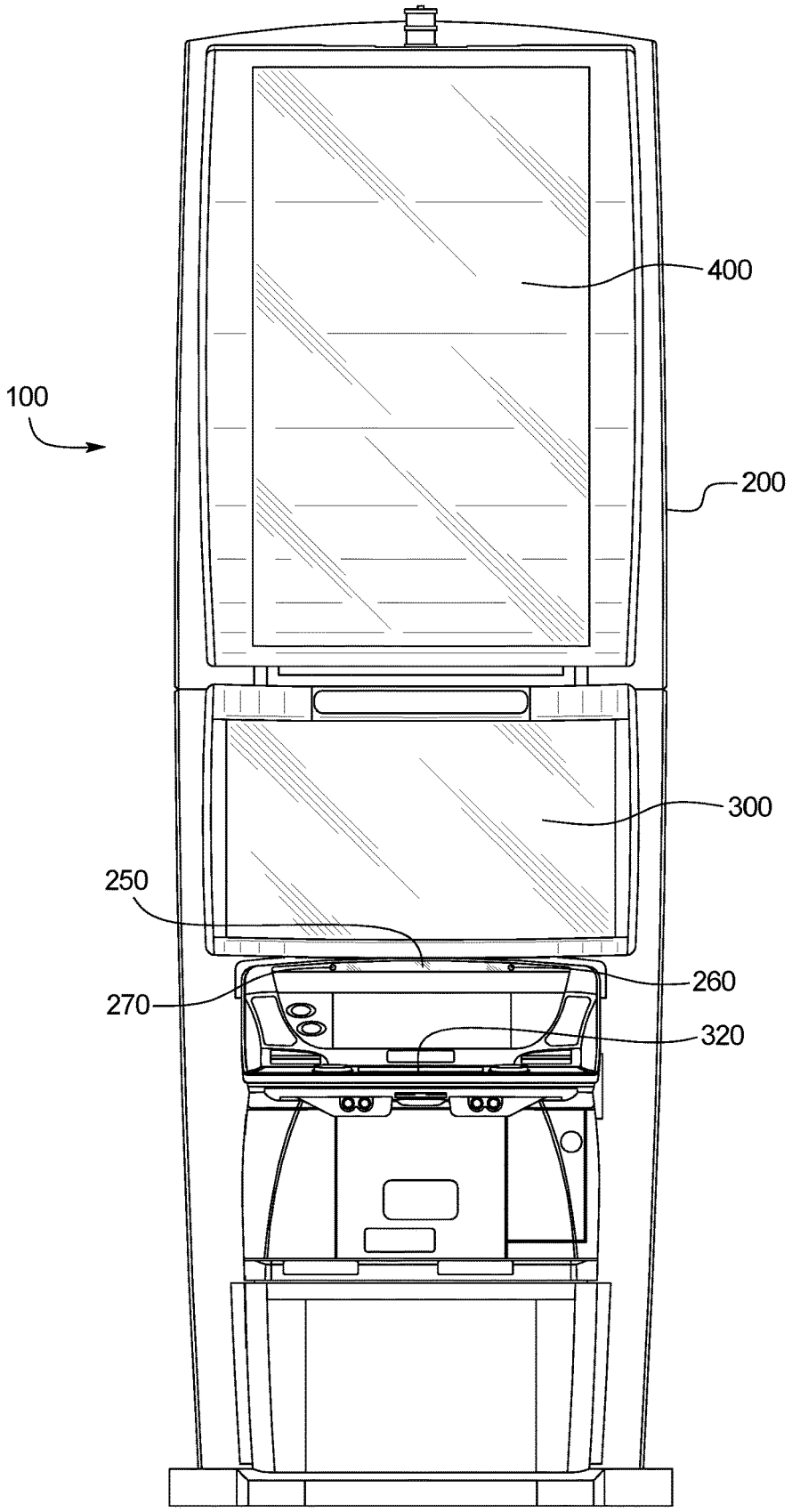
FIG. 2 is a front view of the electronic gaming machine of FIG. 1.
Figure 3:
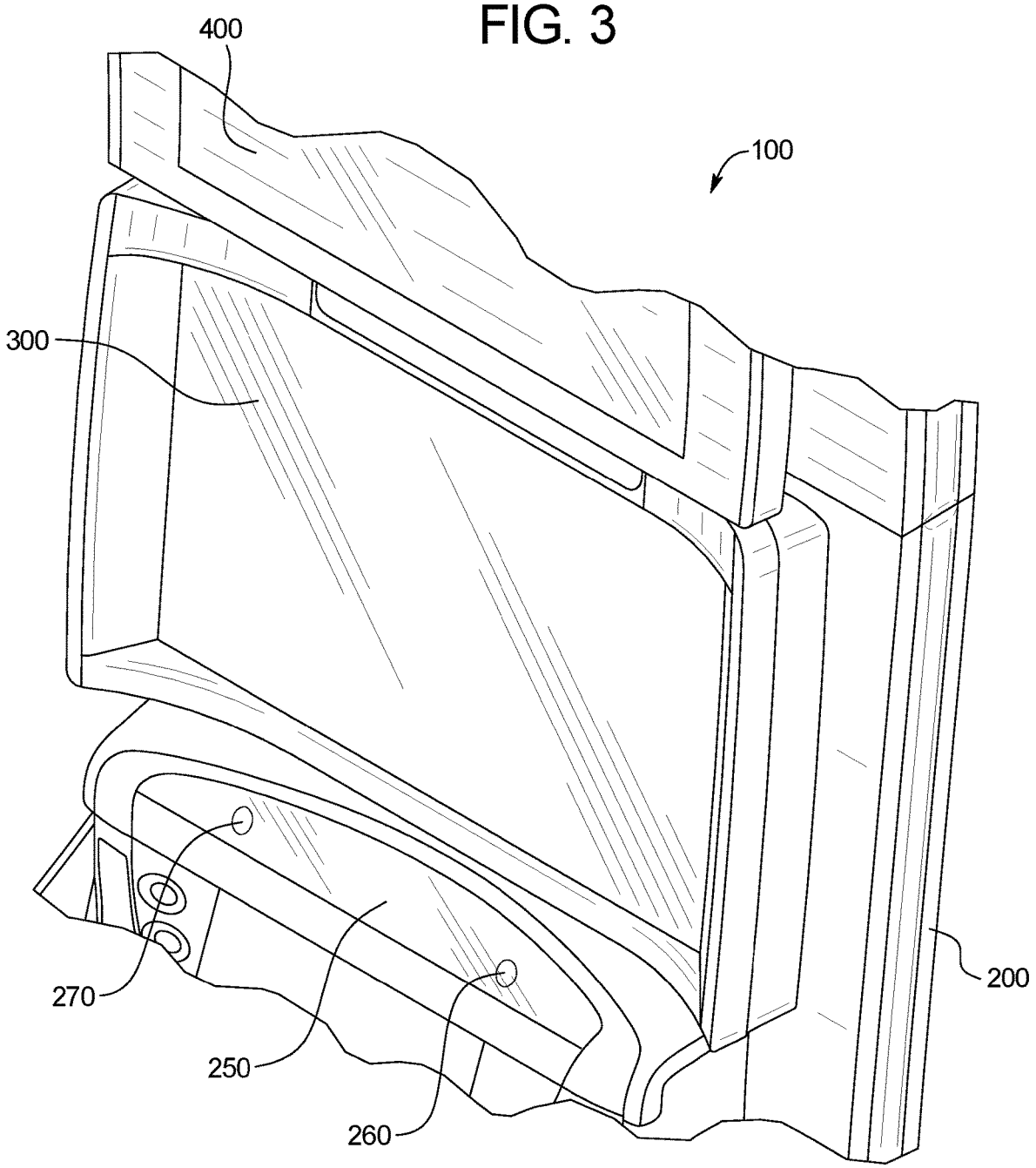
FIG. 3 is an enlarged fragmentary front perspective view of the central portion of the electronic gaming machine of FIG. 1.
Figure 4:
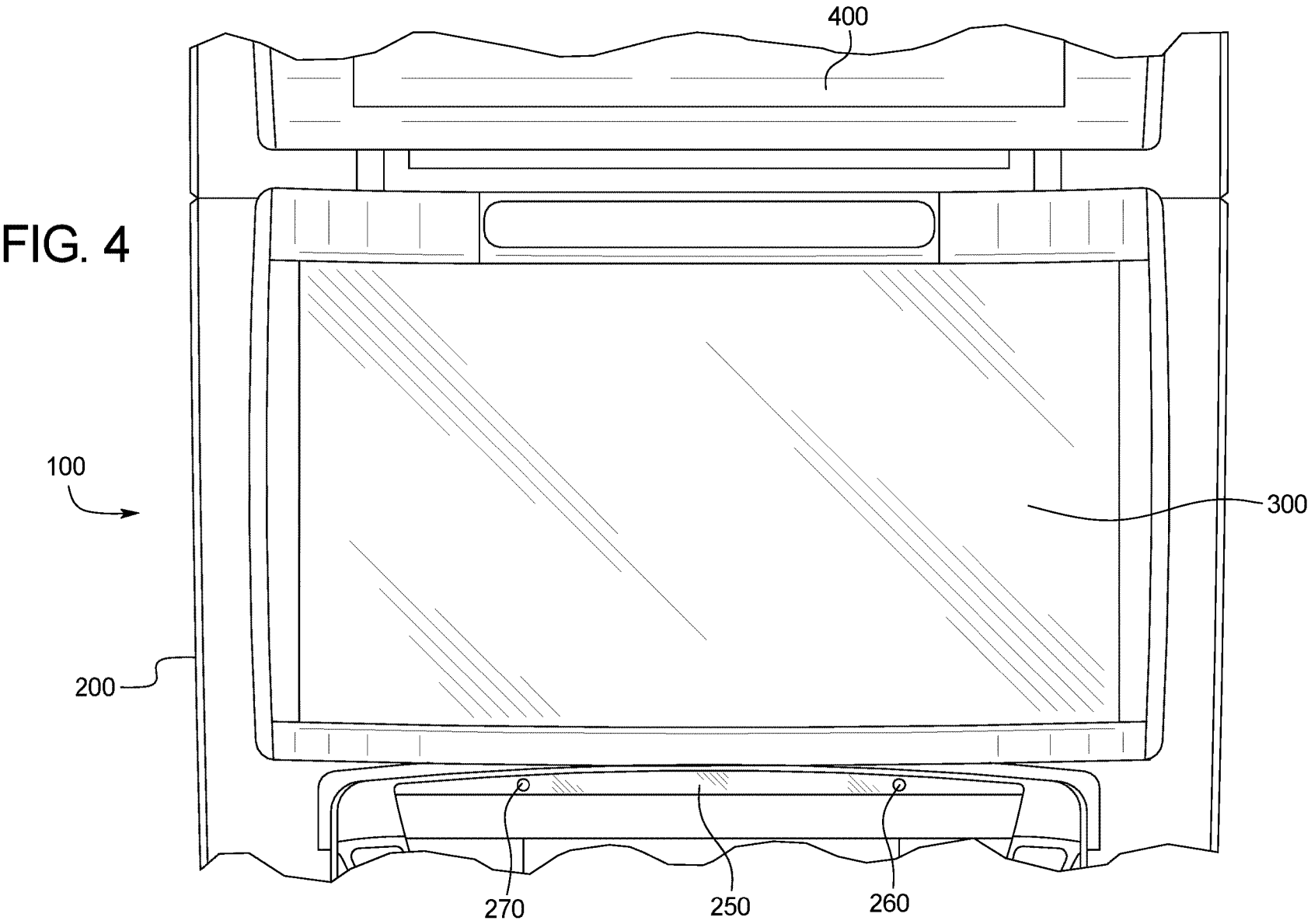
FIG. 4 is an enlarged fragmentary front view of the central portion of the electronic gaming machine of the gaming system of FIG. 1.
Figure 5:
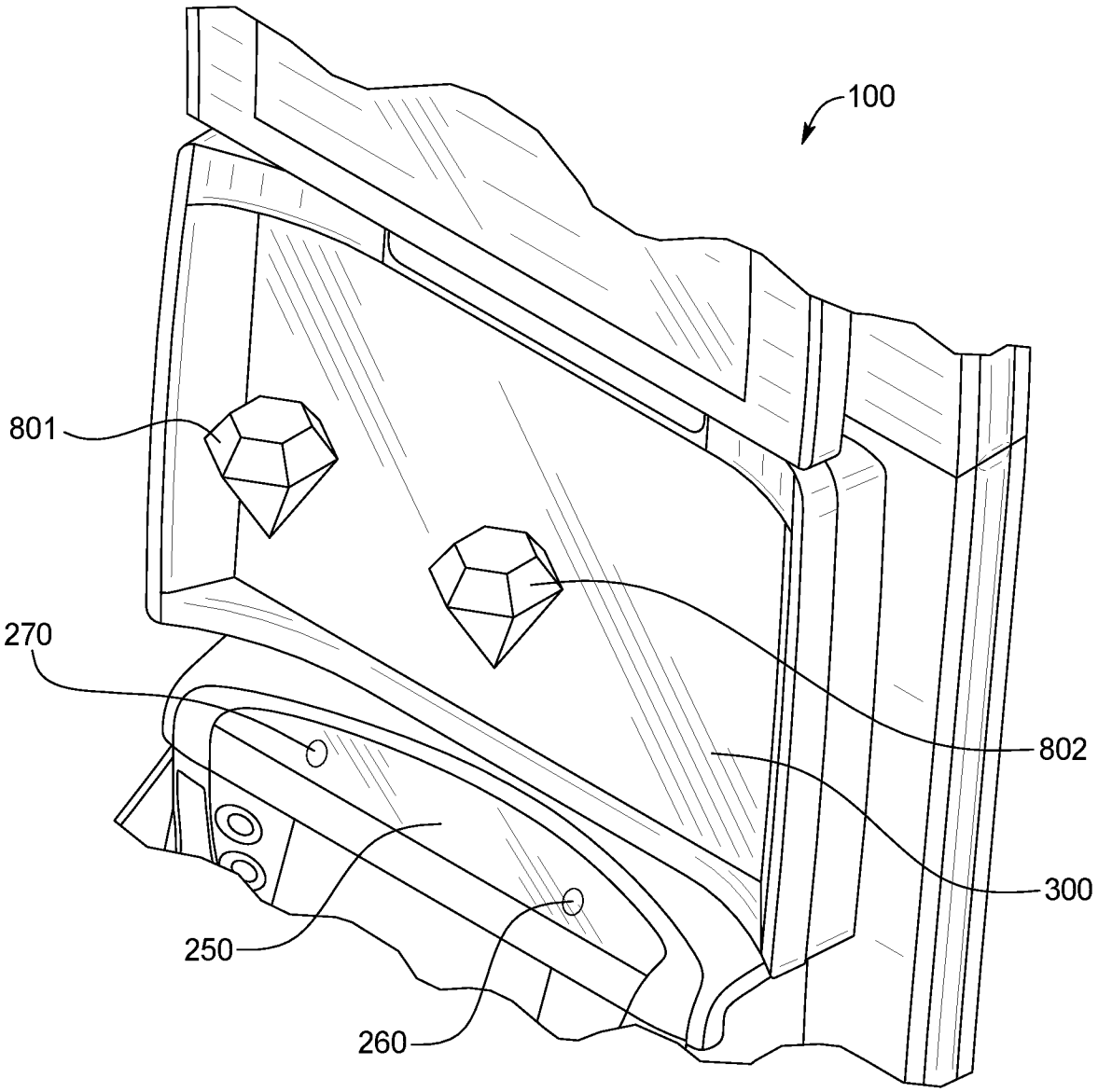
FIG. 5 is an enlarged fragmentary front perspective view of the central portion of the electronic gaming machine of FIG. 1, showing the electronic gaming machine of FIG. 1 displaying two player selectable objects in the form of 3D images in front of the electronic gaming machine.

The present disclosure provides new gaming systems and methods of operating such new gaming systems. In various embodiments, the gaming system and method of the present disclosure provide an electronic gaming machine ("EGM") and an associated player chair configured to operate with the EGM to provide player tactile feedback based on player eye gaze data obtained by the EGM, and thus provide enhanced physical player interaction. In various embodiments, the player tactile feedback is provided as an acknowledgement by the gaming system of the player's selection of an object using the player's eyes within a designated period of time after the player's selection of the object using the player's eyes. In various embodiments, the object includes an input device (such as a physical or virtual input button), and the player tactile feedback is provided as an acknowledgement by the gaming system of the player's actuation of the input device using the player's eyes within a designated period of time after the player's actuation of the input device using the player's eyes. For brevity and clarity, and unless specifically stated otherwise, the term "EGM" is used herein to refer to an electronic gaming machine (such as but not limited to a slot machine, a video poker machine, a video card machine, a video lottery terminal (VLT), a video keno machine, or a video bingo machine).

In various example embodiments of the present disclosure, the EGM includes, among other components: (1) a display device configured to display objects such as images to a player; and (2) a player eye tracker configured to track movement of the eyes of the player in real time and create eye gaze data; and the player gaming chair includes, among other components, a player tactile feedback provider configured to provide tactile feedback to the player directly or indirectly based on the eye gaze data (and thus the determined movement(s) of the player's eyes). In various embodiments of the present disclosure, the EGM further includes a processor and a memory device that stores a plurality of instructions that, when executed by the processor, cause the processor to operate with the display device, the player eye tracker, and the player tactile feedback provider of the player gaming chair to provide player tactile feedback to the player within a designated time period based on player eye gaze data (such as in association with a play of a primary wagering or a secondary game). In various such example embodiments, the gaming system uses the player tactile feedback provider to produce one or more tactile sensations that can be sensed by the player on a real time or substantially real time basis to provide the player an acknowledgement that the EGM has determined that the player has used the player's eyes to make an input to the EGM such as selecting a displayed object with the player's eyes.

In various embodiments of the present disclosure, the EGM includes a display device configured to display the player selectable objects as 3D images perceivable by a player without requiring the player to wear 3D glasses. For brevity, the term "3D images" used herein includes any 3D image or 3D images or other content shown in 3D.

Certain of the components of an example EGM and an example player chair of the present disclosure including those that co-act to provide the enhanced physical player interaction provided by the gaming chair are first discussed below under the ENHANCED PHYSICAL PLAYER INTERACTION PRIMARY COMPONENTS section heading. The various other components that can be provided with an EGM of the present disclosure are then subsequently discussed below under the EGM—GENERAL COMPONENTS AND OPERATION section heading. These headings are not meant to limit the scope of the present disclosure in any manner. It should also be appreciated that the present disclosure can be used in other suitable machines.

Enhanced Physical Player Interaction Primary Components

Referring now to FIGS. 1, 2, 3, 4, 5, 6, and 7, one example gaming system of the present disclosure is generally illustrated and indicated by numeral 50. This example gaming system generally includes an EGM 100 and a player chair 500. This example EGM 100 illustrated in FIGS. 1, 2, 3, 4, 5, 6, and 7 generally includes a housing 200 that supports one or more processors (not shown or labeled and further described below), one or more memory devices (not shown or labeled and further described below), a suitable player eye tracker 250, a plurality of output devices (not all labeled), and a plurality of input devices (not all labeled), among other components.

In this illustrated example embodiment, the player eye tracker 250 is configured to operate with one or more processors of the EGM 100 to track movements of a player's eyes in real time and to generate player eye gaze data based on such tracked movements. In certain embodiments, the player eye tracker 250 is configured to track such movements on a continuous real time basis. In other embodiments, the player eye tracker 250 is configured to track such movements on a regular real time basis (such as at regular intervals). In other embodiments, player eye tracker 250 is configured to track such movements in real time responsive to each occurrence of an eye tracking triggering event (such as but not limited to a display of a plurality of player selectable 3D objects). In certain embodiments, the player eye tracker 250 is configured cause an initiation mode where the player eye tracker 250 request the player to look at an object to initiate the player eye tracker 250 relative to player's eyes.

In this illustrated example embodiment, the player eye tracker 250 of the EGM 100 that is configured to track the movements of the eyes of the player in real time includes one or more eye tracking cameras such as eye tracking cameras 260 and 270 supported by the housing 200 and positioned directly below the display device 300 (further described below). The eye tracking cameras 260 and 270 are configured to track the positions of the player's eyes in real time as they move in front of the EGM 100. For example, the eye tracking cameras 260 and 270 can be configured to track the position of the player's eyes as they move in an eye tracking zone in front of the EGM 100.

In various other example embodiments that are now shown, the EGM includes more than two eye tracking cameras that co-act to track the positions of the player's eyes as they move in front of the EGM 100. In various embodiments, such multiple cameras are suitably positioned. In certain embodiments where the EGM includes multiple cameras, one or more camera sync cables (not shown) configured to sync the multiple cameras can be employed to enhance the accuracy of the determinations of the positions of player's eyes in front of the EGM. It should be appreciated that the image data from the multiple cameras can be synced in other suitable manners in accordance with the present disclosure. It should also be appreciated that quantity and positions of the eye tracking cameras such as eye tracking cameras 260 and 270 in part determine the location of an eye tracking zone in front of the EGM 100. In other words, the eye tracking zone may vary in accordance with the present disclosure based on the configuration and position(s) of the eye tracking camera(s).

In various embodiments, the processor of the EGM 100 receives, collects, and processes eye gaze signals from the player eye tracker cameras 260 and 270 to create the real time player eye gaze data. The real time player eye gaze data of these embodiments includes, for example: (1) data representing where an eye gaze of the player is focusing on in front of the EGM 100; (2) data representing when the eye gaze occurred; (3) data representing a duration of the eye gaze; and/or (4) data representing other suitable information regarding the eye gaze. The real time player eye gaze data may further include or otherwise be associated with player eye gaze contextual data such as game based display data (such as data representing content displayed in association with a play of and the timing such content was displayed). Such receipt, collection, and processing of the player's eye gaze signals to create such real time eye gaze data, when coupled with the collected player eye gaze contextual data, provides data regarding inputs made by the player using the player's eyes (such as selections of one of a plurality of displayed 3D objects made by the player).

In various embodiments, the processor of the EGM 100 determines that a player has selected a displayed object based on a designated amount of time that the player's eyes looks at the displayed object. For example, if the EGM 100 determines that the player's eyes has looked at a displayed object for more than one second, the EGM 100 can determine that the player has selected that displayed object. It should be appreciated that the rules implemented regarding player selection of an object may vary in accordance with the present disclosure. It should be appreciated that the EGM can be configured to display an explanation of the rules implemented regarding player selection of an object to the player (such as how long a player must look at an object to select that object). It should be appreciated that in various embodiments, the time frames may be shorter or longer. For example, in a moving bubble popping example, where the displayed images are moving bubbles, and the player must look at each bubble to pop the bubble (to win an award associated with the bubble), the duration for each look at a bubble may be substantially shorter to provide a fast pace game.

In the example gaming system illustrated in FIGS. 1, 2, 3, 4, 5, 6, and 7, the gaming chair 500 includes: (1) a suitable frame 510; (2) a seat 520 connected to and supported by the frame 510; (3) a seat back 530 connected to and supported by the frame 510; and (4) a plurality of player tactile feedback providers and 550*a* and 550*b*. Each of the plurality of player tactile feedback providers 550*a* and 550*b* is communicatively connected to and configured to receive actuation signals from the processor of the EGM 100 in this illustrated example embodiment.

Figure 6:
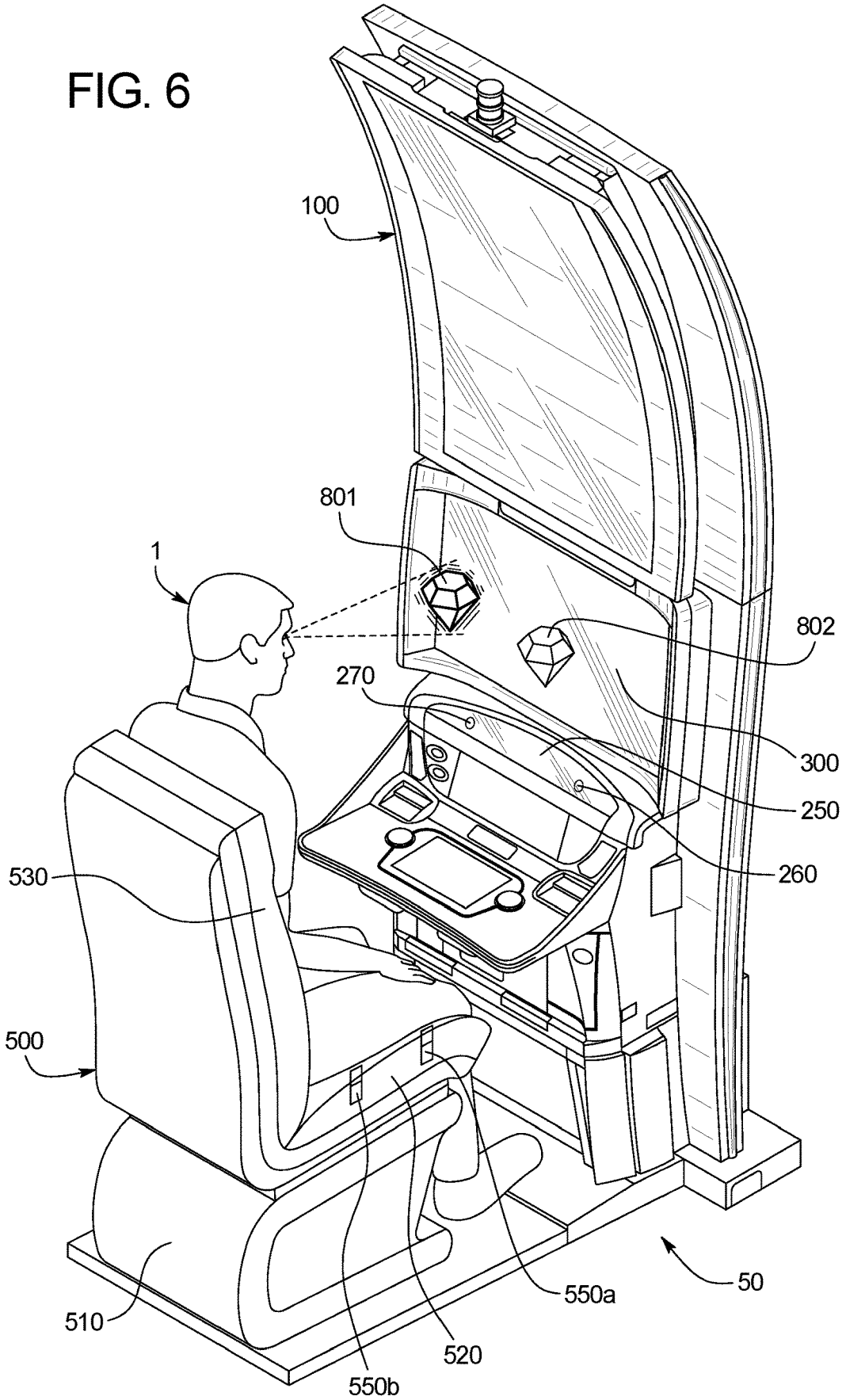
FIG. 6 is a front perspective view of the electronic gaming machine of FIG. 1 and one example embodiment of a player chair of the gaming system of the present disclosure configured to operate with the electronic gaming machine, and showing the electronic gaming machine displaying two player selectable objects in front of the electronic gaming machine and the player selecting one of the displayed objects with the player's eyes.
Figure 7:
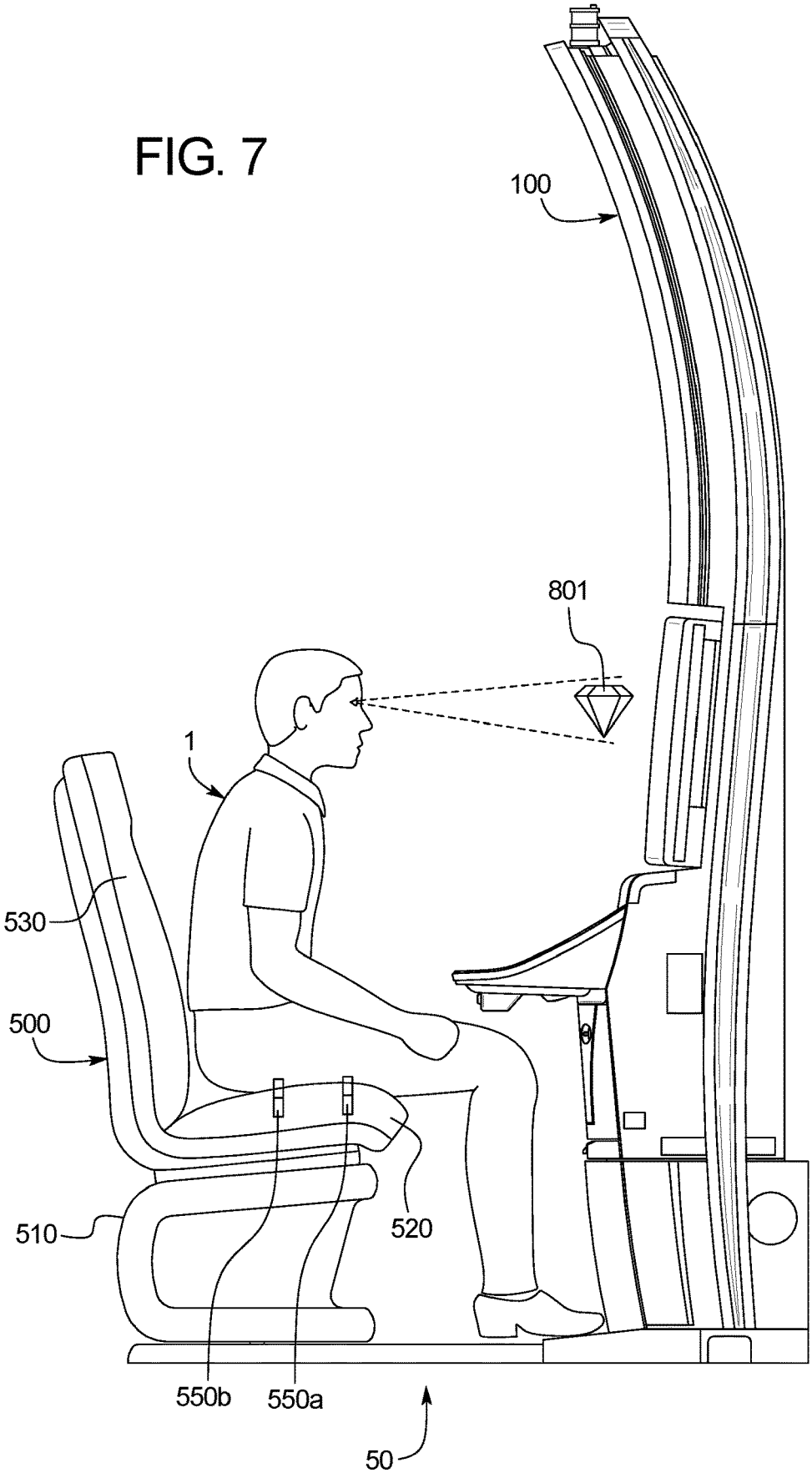
FIG. 7 is a side view of the electronic gaming machine of FIG. 1 and the player chair of FIG. 6, and showing the player selecting one of the displayed objects with the player's eyes.

As best shown in FIGS. 6 and 7, Each of the plurality of player tactile feedback providers 550*a* and 550*b* is configured to provide a physical interaction or physical sensation that the player can physically feel. In various example embodiments, each of the player tactile feedback providers 550*a* and 550*b* includes a physical player contactor or engager (such as an movable pin (not shown or labeled)) that is configured to contact or engage the player 1 to provide the player a physical sensation. More specifically, in this illustrated example embodiment, each of the plurality of player tactile feedback providers 550*a* and 550*b* includes: (1) a housing (not shown or labeled); (2) a player contactor (not shown or labeled) in the form of a movable pin (not labeled) in the housing; and (3) a player contactor actuator (not shown or labeled) in the form of a pin actuator (not labeled) in the housing and coupled to or with the movable pin.

It should be appreciated that the player tactile feedback provider can be otherwise suitably configured in accordance with the present disclosure.

For example, in other embodiments of the present disclosure, one or more of the player tactile feedback providers includes a vibration device that is configured to provide the player a physical sensation. In various such example embodiments, the player tactile feedback provider includes one or more transducers positioned in part of the player chair such as a base of the player chair to create a rumble effect that the player can feel in the seat of the player chair. In certain such embodiments, the transducers are Earthquake MQB-1 Tactile Transducers which are commercially available. In various such example embodiments, the processor executes software to control of the intensity and pattern of the rumble through manipulation of an audio channel.

In various such example embodiments, when the eye tracker detects that a player is surveying a game screen displayed by the EGM, and that their eye gaze passes over a displayed object of interest (such as an item that can be selected by the player), then the EGM causes the transducers to provide a relatively low intensity rumble to alert the player. This may coincide with one or more visual and/or audio cues additionally provided by the EGM. In various such example embodiments, if the player then keeps their gaze on the specific displayed item to select it, then the EGM causes the transducers to provide a more intense rumble to confirm the interaction and give the player the appropriate tactile feedback. This can coincide with one or more audio and/or visual cues as well provided by the EGM. In various such example embodiments, the audio cues and particularly the sounds are specific to and coordinated with the intensity of the rumble (or vibration).

Thus, in certain such example embodiments, one or more of the player tactile feedback providers of the gaming chair includes one or more ultrasonic transducers. The ultrasonic transducers are configured to produce and send the directed sound waves toward the player to cause the player to feel or sense one or more pulses or the sound waves produced by such devices. It should be appreciated that the types, quantity, configurations, sizes, and placements of the player tactile feedback providers may vary in accordance with the present disclosure.

In other example embodiments of the present disclosure, one or more of the player tactile feedback providers includes one or more other sound wave producing devices that is/are configured to provide the player a physical sensation (other than or in addition to sound(s)).

In various example embodiments, the present disclosure further contemplates that the length, pattern, and/or intensity of the tactile feedback provided by the player chair can be based on the different selectable objects, time frames between selecting the selectable objects, the amount of time the player's eyes are fixed on the selected object, and/or any other suitable factors.

In various example embodiments, the present disclosure further contemplates that different types of tactile feedback can be provided by the player chair for or in association with different selectable objects, different time frames between selecting the selectable objects, the amounts of time the player's eyes are fixed on the selected object(s), and/or any other suitable factors.

In this illustrated example embodiment, the plurality of output devices of the EGM 100 includes: (a) a first or intermediate display device 300; (b) a second or upper display device 310 positioned above the first or intermediate display device 300; and (c) a third or lower display device 320 positioned below the first or intermediate display device 300. These output devices are configured to display the games, game components, game instructions, game inputs, game outputs, game outcomes, game awards (such as the primary and/or secondary games awards), and various other functionality and information to the player. In this illustrated example embodiment, the plurality of player input devices enable the player to play one or more wagering games provided by the EGM 100. Such output devices and such player input devices can also include one or more of the devices described below in the second section of this detailed description. These player input devices are physically touchable and thus activatable by the player to enable the player to make inputs into the EGM 100. These output devices and input devices are configured such that a player may operate the EGM while sitting in front of the EGM 100 such as when sitting on the player chair 500 such that the player's head is approximately at the same height as the first display device 300 as shown in FIGS. 6 and 7.

In this illustrated example embodiment, the first display device 300 of the EGM 100 is configured to display 3D images to the player without requiring the player to wear 3D glasses and includes one or more lenticular lenses (not shown). In various embodiments, the first display device 300 including the lenticular lenses is configured to display what appears to the player as 3D objects in front of the EGM 100, and specifically in a player eye tracking zone in front of the first display device 300. Thus, in this illustrated example embodiment of the present disclosure, the first display device 300 is configured to display 3D objects in the form of 3D images to the player in front of the EGM 100 without requiring the player to wear 3D glasses. It should also be appreciated that other suitable 3D or virtual object displaying systems or devices can be employed in accordance with the present disclosure.

In this illustrated example embodiment, (1) the player eye tracker 250 and specifically the player eye tracking cameras 260 and 270 of the EGM 100 are configured to track the movements of the eyes of the player relative to the displayed 3D objects; (2) the processor of the EGM 100 is configured to operate with the player eye tracker 250 to create player eye gaze data based on the tracked movements of the player's eyes; (3) the processor of the EGM 100 is configured to send signals to the player tactile feedback providers 550*a* and 550*b* of the player chair 500 based on the player eye gaze data; and (4) the player tactile feedback providers 550*a* and 550*b* of the player chair 500 are configured to provide tactile feedback to the player based on the signals received from the EGM 100. This processor and the and memory device of the EGM 100 thus co-act with the above mentioned components to provide the enhanced physical player interaction with the EGM 100 and player gaming chair 500.

It should be appreciated that: (1) the first display device 300; (2) the player eye tracker 250; and (3) the player tactile feedback providers 550*a* and 550*b*, may each be individually configured or may alternatively be configured to operate with the processor(s) and memory device(s) of the EGM 100 to provide each of their designated functions described herein. In other words, (1) the first display device 300 may be individually configured to display 3D images or may be configured to operate with the processor(s) and memory device(s) of the EGM 100 to display the 3D images; (2) the player eye tracker 250 may be individually configured to track the movement of the eyes of the player or may be configured to operate with the processor(s) and memory device(s) to track the movement of the eyes of the player; and (3) the player tactile feedback providers 550*a* and 550*b* may be individually configured to provide tactile feedback to the player or may be configured to operate with the processor(s) and memory device(s) of the EGM 100 to provide tactile feedback to the player. Alternatively, one or more of the processor or memory device may be remote from the EGM 100. For example, it should also be appreciated that the player eye gaze data may be determined by one or more other local or remote systems based on the signals received from the player eye tracker 250. For purposes of this disclosure and for brevity, each of these devices are sometimes discussed as performing such tasks individually or operating with the one or more processors and memory devices to perform such tasks, and such descriptions are not intended to limit the present disclosure to either configuration.

In certain embodiments, the first display device 300, the player eye tracker 250, the player tactile feedback providers 550*a* and 550*b*, the processor, and the memory device of the EGM 100 are configured to provide the enhanced physical player interaction of the present disclosure by operating to: (1) cause the first display device 300 to display 3D objects such that a player in front of the first display device 300 can see the displayed 3D objects in a player interaction zone in front of the first display device or projecting toward the player such as shown in FIGS. 6 and 7; (2) determine movements of the player's eyes looking at the displayed virtual object(s) in the player eye tracking zone as indicated in FIGS. 6 and 7; (3) enable the player to select the displayed 3D objects in the player eye tracking zone as indicated in FIGS. 6 and 7; and (4) cause a physical interaction with the player to occur to give the player an acknowledgment that the EGM understands that the player has selected one of the displayed 3D objects.

In various embodiments, the gaming system provides the tactile player feedback to the player: (1) on a real time or substantially real time basis; or (2) within another designated time period after the player's eyes select the displayed object (such as within one second of the player eye selection of the displayed object). Thus, in various embodiments, the EGM 100 captures the player eye movements and causes the player chair 500 to provide the tactile feedback to the player with no or little lag time. It should be appreciated that this time period may vary in accordance with the present disclosure.

Referring now again to FIGS. 6 and 7, one example of how the gaming system can function to provide the enhanced physical player interaction is generally illustrated. It should be appreciated that the present disclosure is not limited to this example, and that the gaming system of the present disclosure can provide various different types of enhanced physical player interaction. FIGS. 6 and 7 illustrate the EGM 100 displaying two player selectable 3D objects 801 and 802 in a player eye tracking zone in front of the display device 300 prior to a player selecting one of the 3D objects. Of course, it should be appreciated that these displayed objects 801 and 802 are not real, but rather what a player would see looking at the first display device 300. FIG. 7 shows the EGM displaying the 3D object 801 in front of the display device 100, the 3D object 801 selected by the player using the player's eyes, and the gaming chair 500 subjecting the player to tactile feedback that causes the player to feel one or more sensations corresponding to the player selecting the 3D object 801. This example is an example of how the gaming system of the present disclosure can be used to provide a selection game such as a bonus selection game where the player selects one or more displayed 3D objects using the player's eyes to obtain awards.

Figure 8:
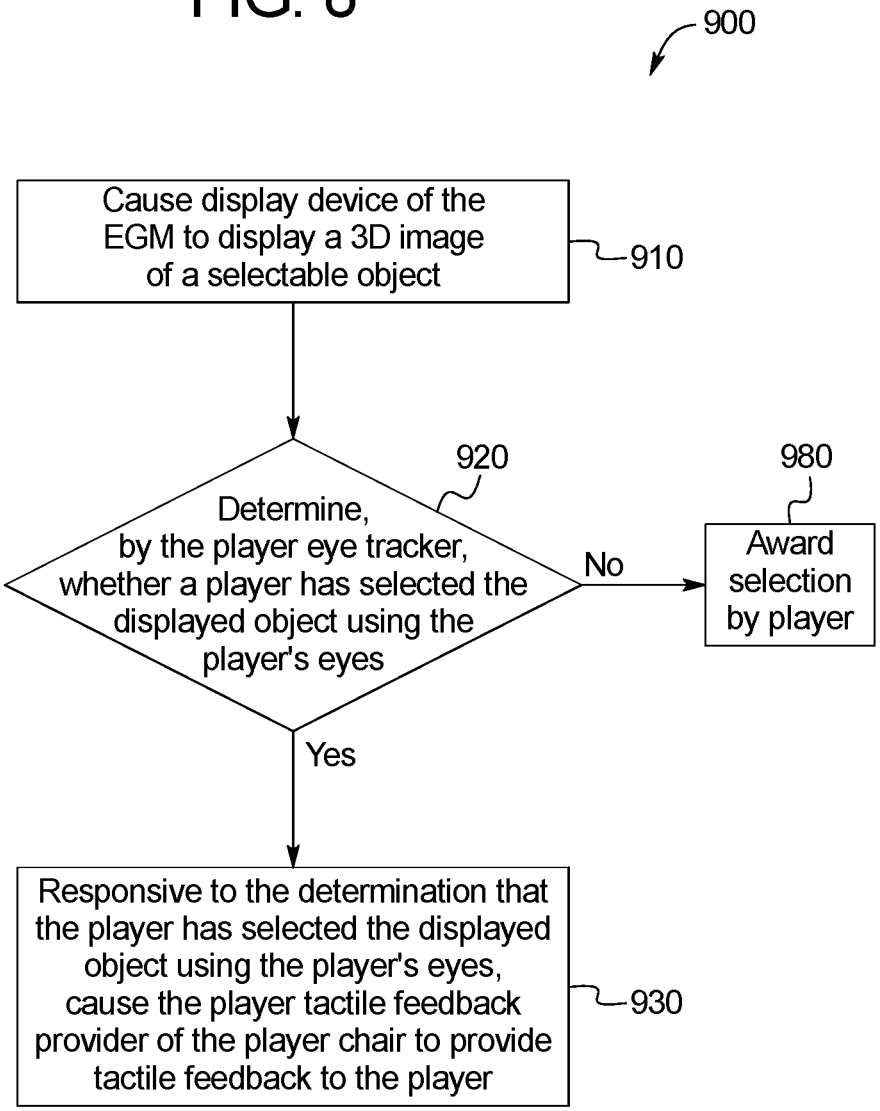
FIG. 8 is a flowchart of one embodiment of a method of operating the gaming system disclosed herein, illustrating the display of the object to a player, the determination of the player selecting the object using the player's eyes, and the tactile feedback provided to the player.
Figure 9:
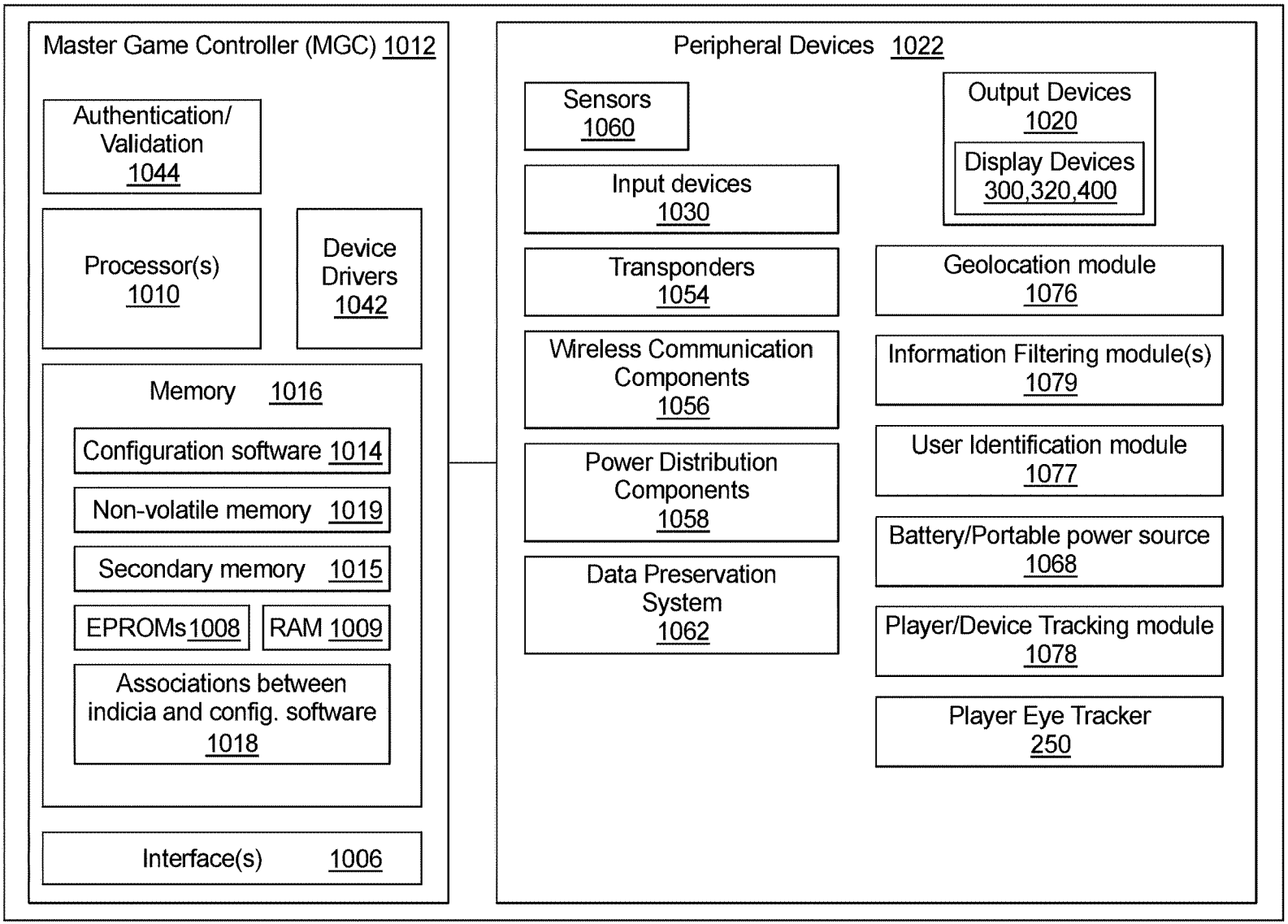
FIG. 9 is a schematic block diagram of one example embodiment of the electronic configuration of the electronic gaming machine of the present disclosure.

Referring now to FIG. 8, FIG. 8 is a flowchart of one example method of operating the gaming system including an electronic gaming machine and a player chair of the present disclosure. In various embodiments, the method 900 is represented by a set of instructions stored in one or more memories and executed by one or more processors. Although the method 900 is described with reference to the flowchart shown in FIG. 8, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed. This example method 100 generally includes: (1) causing a display device of the EGM to display a selectable object (such as a 3D image of a selectable object) as indicated by block 910; (2) determining, by a player eye tracker, whether a player has selected the displayed object using the player's eyes as indicated by diamond 920; and (3) responsive to the determination that the player has selected the displayed object using the player's eyes, cause a player tactile feedback provider of the player chair to provide a tactile feedback to the player as indicated by block 930. As indicated by block 980, if the player has not selected the displayed object using the player's eyes, the EGM awaits player section of the displayed object for a period of time, or can perform another function (not shown in FIG. 8).

In various embodiments of the present disclosure, at the same time, slightly before, or slightly after the gaming system causes the player tactile feedback, the EGM can additionally cause the display device 300 to alter the displayed 3D object selected by the player (such as by altering a color, shape, movements or other characteristic of the displayed 3D object) to provide the player a further acknowledgement of the player selection of the 3D object. This can also be used to further continue the interaction with the displayed 3D object by the player.

In various embodiments of the present disclosure, the EGM includes one or more sound producing devices (such as speakers) that produce one or more sounds that are coordinated with the player tactile feedback provided to the player by the player chair to further enhance the physical player interaction.

It should thus be appreciated that the gaming system and particularly the player chair can provide enhanced physical player interaction in multiple different manners. For example, in various embodiments of the present disclosure, the gaming system provides the enhanced physical player interaction in conjunction with player eye selection of one or more various game objects (such as but not limited to game symbols, game cards, game reels, game wheels, game tiles, game dice, game chips, game balls, game selections, game characters, game awards, game outcomes, or other game objects) or other functional object. It should be appreciated that the present disclosure is not limited to these examples.

In one such example embodiment, the present disclosure can be employed in conjunction with a primary or secondary game that displays a series of moving 3D objects (such a bubbles) in the player eye tracking zone. Each time the EGM determines that the player has looked at one of the displayed objects (i.e., the bubbles), the EGM provides the player an award (or point toward winning an award) and causes the player tactile feedback provider to provided tactile feedback to the player that that moving 3D object was looked at by the player.

In various embodiments of the present disclosure, the gaming system provides the enhanced physical player interaction in conjunction with other functionality provided by the EGM to the player. For example, the EGM can display virtual images of a series of different drinks in the player eye tracking zone and enable to player to select one of the virtual images with the player's eyes. When the player selects the drink, the EGM can use the player tactile feedback provider to provide feedback to the player indicating that a drink has been selected by the player.

As mentioned above, in various alternative embodiments of the present disclosure, the selectable object can be an input device, and the player tactile feedback is provided as an acknowledgement by the gaming system of the player's actuation of the input device using the player's eyes within a designated period of time after the player's actuation of the input device using the player's eyes. For example, the selectable object(s) can be a play input button, a repeat the bet button, and/or a max bet button. When the EGM determines that the player has selected and thus activated such a button, the EGM can use the player tactile feedback provider to provide tactile feedback to the player indicating that that the button has been selected and thus activated by the player. The EGM can then perform the action associated with the activated input button such as causing a play of a primary game. It should be appreciated that these input buttons can be physical buttons or virtual displayed (2D or 3D) buttons in accordance with the present disclosure.

In further various alternative embodiments of the present disclosure, the selectable object can be a cashout input device, and the player tactile feedback is provided as an acknowledgement by the gaming system of the player's actuation of the input device using the player's eyes within a designated period of time after the player's actuation of the input device using the player's eyes. When the EGM determines that the player has selected and thus activated such a cashout button, the EGM can use the player tactile feedback provider to provide tactile feedback to the player indicating that this input button has been selected and thus activated by the player. The EGM can then perform the action associated with the cashout input button such as causing a cashout from the EGM. It should be appreciated that this input button can be a physical button or a virtual displayed (2D or 3D) button in accordance with the present disclosure.

In further various alternative embodiments of the present disclosure, the player chair includes two or more different player tactile feedback providers. The different player tactile feedback providers can be employed to provide different tactile feedback to the player associated with different displayed objects or different input devices.

In further various alternative embodiments of the present disclosure, the gaming system can employ one or more of the player tactile feedback providers to provide player tactile feedback to the player based on player eye gaze data that is not associated with the player selection of a displayed object or input selection or device. For example, the player eye gaze data may be associated with an area of a display device that the player looks at repeatedly. In another example, the player eye gaze data may be associated with the player not looking at a display device of the EGM, and the EGM determining that the player should look at a display device of the EGM because something important is displayed by that display device or is about to be displayed by that display device.

In various embodiments of the present disclosure, the EGM additionally or alternatively includes a player head tracker configured to track movement of the head of the player and use data from the head tracker to determine when to activate the player tactile feedback provider(s).

As indicated above, in various embodiments of the present disclosure, a system other than the EGM processes eye gaze signals from the player eye tracker and determines when to activate the player tactile feedback providers.

It should be appreciated that, in various embodiments of the present disclosure, one or more of the player tactile feedback providers can be additionally or alternatively positioned in other parts of the player chair (such as but not limited to the headrest, the footrest, one or more of the armrest, and the back section).

It should be appreciated that, in various alternative embodiments of the present disclosure, one or more of the selectable objects may additionally be 2D displayed objects in addition to the 3D displayed objects.

It should be appreciated that, in various alternative embodiments of the present disclosure or in various instances of game play or otherwise, one or more of the selectable objects may alternatively be 2D displayed objects instead of the 3D displayed objects.

It should be appreciated from the above that various embodiments of the present disclosure improve gaming technology by providing a more real time interactive experience for the player, and more particularly by providing additional types of physical player interaction with the player in the form of player tactile feedback for or based on actions taken by the player, including movements of the player's eyes. In other words, various embodiments of the present disclosure directly link the player's eye movements with physical tactile feedback provided to the player through the player chair.

In certain example embodiments of the present disclosure, these advantages are provided by causing the player tactile feedback provider to provide the tactile feedback to the player as an acknowledgement of the player's selection of the selectable object using the player's eyes within a designated period of time after the player's selection of the selectable object using the player's eyes.

In other example embodiments of the present disclosure, these advantages are provided by causing the tactile feedback to be provided at a first level responsive to the player eye tracker detecting that the player's eyes pass over the selectable object and causing the tactile feedback to be provided at a second higher level responsive to the player eye tracker detecting that the player's eyes remain on the selectable object for a designated time period.

In other example embodiments of the present disclosure, these advantages are provided by causing the tactile feedback to be based on an amount of time the player's eyes are fixed on the selectable object.

In other example embodiments of the present disclosure, these advantages are provided by controlling the tactile feedback to the player using the sound control systems of the EGM. In other words, various embodiments of the present disclosure control the physical feedback providers to provide the additional tactile feedback to the player as if the physical feedback providers are sound generators.

EGM—General Components and Operation

The EGM and the player chair of the present disclosure can be controlled locally by one or more processors, and/or remotely or partially remotely by one or more remote processors, central servers, central controllers, or remote host. In various embodiments, the EGM and the player chair of the present disclosure can be part of a gaming system (which is also part of the present disclosure) that includes one or more EGMs and one or more player chairs in combination with one or more remote processors, central servers, central controllers, or remote hosts. In such embodiments, the EGM is configured to communicate with the remote processors, central servers, central controllers, or remote hosts through a data network or remote communication link. In certain such embodiments, the EGM is configured to communicate with one or more other EGMs through the same data network or remote communication link or through a different data network or remote communication link.

In certain embodiments in which the gaming system includes an EGM in combination with a remote processor, central server, central controller, or remote host, the remote processor, central server, central controller, or remote host is any suitable computing device that includes at least one processor and at least one memory device or data storage device. As further described herein, the EGM includes at least one EGM processor configured to transmit and receive data or signals representing events, messages, commands, or any other suitable information between the EGM and the remote processor, central server, central controller, or remote host. The at least one processor of that EGM is configured to execute the events, messages, or commands represented by such data or signals in conjunction with the operation of the EGM. Moreover, the at least one processor of the remote processor, central server, central controller, or remote host is configured to transmit and receive data or signals representing events, messages, commands, or any other suitable information between the remote processor, central server, central controller, or remote host and the EGM. One, more than one, or each of the functions of the at least one processor of the EGM may be performed by the remote processor, the central server, the central controller, or the remote host.

In certain such embodiments, computerized instructions for controlling any games (such as any primary or base games and/or any secondary or bonus games) displayed by the EGM are executed by the remote processor, central server, central controller, or remote host. In such "thin client" embodiments, the remote processor, central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the remote processor, central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a remote processor, central server, central controller, or remote host, computerized instructions for controlling any primary or base games displayed by the EGM are communicated from the remote processor, central server, central controller, or remote host to the EGM in a thick client configuration, and computerized instructions for controlling any secondary or bonus games or other functions displayed by the EGM are executed by the remote processor, central server, central controller, or remote host in a thin client configuration.

In certain embodiments in which the gaming system includes: (a) an EGM configured to communicate with a remote processor, central server, central controller, or remote host through a data network; and/or (b) a plurality of EGMs configured to communicate with one another through a data network, the data network is a local area network (LAN) in which the EGMs are located substantially proximate to one another and/or the remote processor, central server, central controller, or remote host. In one example, the EGMs and the remote processor, central server, central controller, or remote host are located in a gaming establishment or a portion of a gaming establishment.

In other embodiments in which the gaming system includes: (a) an EGM configured to communicate with a remote processor, central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the remote processor, central server, central controller, or remote host. For example, one or more of the EGMs are located: (a) in an area of a gaming establishment different from an area of the gaming establishment in which the remote processor, central server, central controller, or remote host is located; or (b) in a gaming establishment different from the gaming establishment in which the remote processor, central server, central controller, or remote host is located. In another example, the remote processor, central server, central controller, or remote host is not located within a gaming establishment in which the EGMs are located. In certain embodiments in which the data network is a WAN, the gaming system includes a remote processor, central server, central controller, or remote host and an EGM each located in a different gaming establishment in a same geographic area, such as a same city or a same state. Gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a remote processor, central server, central controller, or remote host through a data network; and/or (b) a plurality of EGMs configured to communicate with one another through a data network, the data network is an internet (such as the Internet) or an intranet. In certain such embodiments, an Internet browser of the EGM is usable to access an Internet game page from any location where an Internet connection is available. In one such embodiment, after the EGM accesses the Internet game page, the remote processor, central server, central controller, or remote host identifies a player prior to enabling that player to place any wagers on any plays of any wagering games. In one example, the remote processor, central server, central controller, or remote host identifies the player by requiring a player account of the player to be logged into via an input of a unique username and password combination assigned to the player. The remote processor, central server, central controller, or remote host may, however, identify the player in any other suitable manner, such as: by validating a player tracking identification number associated with the player; by reading a player tracking card or other smart card inserted into a card reader (as described below); by validating a unique player identification number associated with the player by the remote processor, central server, central controller, or remote host; or by identifying the EGM, such as by identifying the MAC address or the IP address of the Internet facilitator. In various embodiments, once the remote processor, central server, central controller, or remote host identifies the player, the remote processor, central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server".

The remote processor, central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

Referring now to FIG. 8, in various embodiments, an EGM 1000 of the present disclosure includes a master gaming controller 1012 configured to communicate with and to operate with a plurality of peripheral devices 1022 (such as the above described devices 250, 300, 320, and 400).

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets."

In certain embodiments, in addition to the input, output and other components described in the first section above, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one portable power source 1068; (10) at least one user identification module 1077; (11) at least one player/device tracking module 1078; and (13) at least one information filtering module 1079.

The at least one output device 1020 includes at least one display device configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGM may include a ticket printer and dispenser. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method."

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 includes one or more sound generating devices controlled by one or more sound cards. In one such embodiment, the sound generating device includes one or more speakers or other sound generating hardware and/or software configured to generate sounds, such as by playing music for any games or by playing music for other modes of the EGM, such as an attract mode. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance.

In various embodiments, the at least one input device includes a plurality of buttons that are programmable by the EGM operator to, when actuated, cause the EGM to perform particular functions. For instance, such buttons may be hard keys, programmable soft keys, or icons displayed on a display device of the EGM (described below) that are actuatable via a touch screen of the EGM (described below) or via use of a suitable input device of the EGM (such as a mouse or a joystick).

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, in addition to the components described in the first section above, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM (in addition to the detections described above); detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

In addition to the eye tracker 250 described above, the EGM of the present disclosure can also include at least one motion/gesture analysis and interpretation component (not shown) configured to analyze and/or interpret information relating to detected player movements and/or gestures to determine appropriate player input information relating to the detected player movements and/or gestures. For example, in one embodiment, the at least one motion/gesture analysis and interpretation component is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM 1000 to operate in a mobile environment.

The EGM may include at least one geolocation module (not shown) configured to acquire geolocation information from one or more remote sources and use the acquired geolocation information to determine information relating to a relative and/or absolute position of the EGM. For example, in one implementation, the at least one geolocation module is configured to receive GPS signal information for use in determining the position or location of the EGM. In another implementation, the at least one geolocation module is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

In certain embodiments, the EGM is a device that has obtained approval from a regulatory gaming commission, and in other embodiments, the EGM is a device that has not obtained approval from a regulatory gaming commission.

The EGMs described above are merely examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (sometimes referred to herein as "primary games") and/or any secondary or bonus games or other functions (sometimes referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a remote processor, central server, central controller, or remote host and a changeable EGM, the at least one memory device of the remote processor, central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the remote processor, central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the EGM randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process.

In one such embodiment, each game outcome or award is associated with a probability, and the EGM generates the game outcome(s) and/or the award(s) to be provided based on the associated probabilities. In these embodiments, since the EGM generates game outcomes and/or awards randomly or based on one or more probability calculations, there is no certainty that the EGM will ever provide any specific game outcome and/or award.

In certain embodiments, the EGM maintains one or more predetermined pools or sets of predetermined game outcomes and/or awards. In certain such embodiments, upon generation or receipt of a game outcome and/or award request, the EGM independently selects one of the predetermined game outcomes and/or awards from the one or more pools or sets. The EGM flags or marks the selected game outcome and/or award as used. Once a game outcome or an award is flagged as used, it is prevented from further selection from its respective pool or set; that is, the EGM does not select that game outcome or award upon another game outcome and/or award request. The EGM provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the EGM determines a predetermined game outcome and/or award based on the results of a bingo, keno, or lottery game. In certain such embodiments, the EGM utilizes one or more bingo, keno, or lottery games to determine the predetermined game outcome and/or award provided for a primary game and/or a secondary game. The EGM is provided or associated with a bingo card. Each bingo card consists of a matrix or array of elements, wherein each element is designated with separate indicia. After a bingo card is provided, the EGM randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the EGM is configured to communicate with the remote processor, central server, central controller, or remote host for monitoring purposes only. In such embodiments, the EGM determines the game outcome(s) and/or award(s) to be provided in any of the manners described above, and the remote processor, central server, central controller, or remote host monitors the activities and events occurring on the EGM. In one such embodiment, the EGM includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the EGM includes one or more executable game programs executable by at least one processor of the EGM to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the EGM includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the EGM. In certain such embodiments, the EGM includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The EGM enables a wager to be placed on one or more of such paylines to activate such paylines. In other embodiments in which one or more paylines are formed between at least two adjacent symbol display areas, the EGM enables a wager to be placed on a plurality of symbol display areas, which activates those symbol display areas.

In various embodiments, the EGM provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the EGM employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations".

In various embodiments, the EGM includes a progressive award. Typically, a progressive award includes an initial amount and an additional amount funded through a portion of each wager placed to initiate a play of a primary game. When one or more triggering events occurs, the EGM provides at least a portion of the progressive award. After the EGM provides the progressive award, an amount of the progressive award is reset to the initial amount and a portion of each subsequent wager is allocated to the next progressive award. Examples of progressive gaming systems or EGMs are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the EGM provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the EGM automatically provides or initiates the secondary game upon the occurrence of a triggering event or the satisfaction of a qualifying condition. In other embodiments, the EGM initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the EGM randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the EGM determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system or EGM includes one or more player tracking systems. Such player tracking systems enable operators of the gaming system or EGM (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the EGM to begin a gaming session, the card reader reads the player identification number off the player tracking card to identify the player. The EGM timely tracks any suitable information or data relating to the identified player's gaming session. The EGM also timely tracks when the player tracking card is removed to conclude play for that gaming session. In another embodiment, rather than requiring insertion of a player tracking card into the card reader, the EGM utilizes one or more portable devices, such as a mobile phone, a radio frequency identification tag, or any other suitable wireless device, to track when a gaming session begins and ends. In another embodiment, the EGM utilizes any suitable biometric technology or ticket technology to track when a gaming session begins and ends.

In such embodiments, during one or more gaming sessions, the EGM tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the first display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Certain of the gaming systems described herein, including EGMs located in a casino or another gaming establishment, include certain components and/or are configured to operate in certain manners that differentiate these EGMs and systems from general purpose computing devices (i.e., certain personal gaming devices such as desktop computers and laptop computers).

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are typically not state-based machines, and a majority of data can be lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

It should further be appreciated that the EGM of the present disclosure may have varying or alternative housing configurations.

It should further be appreciated that the EGM of the present disclosure may have varying or alternative display device configurations.

In various embodiments, the EGM of the present disclosure is configured to be positioned on a base or stand.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a player chair comprising a player tactile feedback provider; and an electronic gaming machine associated with the player chair, the electronic gaming machine comprising:

a player eye tracker, a processor, and a memory device storing a plurality of instructions, which when executed by the processor, cause the processor to operate with:

the player eye tracker to determine whether a player has selected a selectable object using the player's eyes, and responsive to the determination that the player has selected the selectable object using the player's eyes, cause the player tactile feedback provider to provide a tactile feedback to the player, wherein the tactile feedback is provided at a first level responsive to the player eye tracker detecting that the player's eyes pass over the selectable object and the tactile feedback is provided at a second higher level responsive to the player eye tracker detecting that the player's eyes remain on the selectable object for a designated time period.

2. The gaming system of claim 1, wherein the plurality of instructions, when executed by the processor, cause the processor to operate with a display device to display the selectable object as part of a play of a game.

3. The gaming system of claim 1, wherein the plurality of instructions, when executed by the processor, cause the processor to operate with a display device to display the selectable object as a 3D image.

4. The gaming system of claim 1, wherein the plurality of instructions, when executed by the processor, cause the processor to operate with the player tactile feedback provider to provide the tactile feedback to the player as an acknowledgement of the player's selection of the selectable object using the player's eyes within a designated period of time after the player's selection of the selectable object using the player's eyes.

5. The gaming system of claim 1, wherein the player tactile feedback provider comprises a player contactor and a player contactor actuator.

6. The gaming system of claim 1, wherein the player tactile feedback provider comprises a transducer.

7. The gaming system claim 6, wherein the plurality of instructions, when executed by the processor, cause the processor to control one of an intensity and a pattern produced by the transducer through an audio channel.

8. The gaming system of claim 1, wherein the plurality of instructions, when executed by the processor, cause the processor to cause the tactile feedback to be based on an amount of time the player's eyes are fixed on the selectable object.

9. The gaming system of claim 1, wherein the selectable object comprises a one of a play button and a wager button.

10. The gaming system of claim 1, wherein the plurality of instructions, when executed by the processor, cause the processor to coordinate one or more sounds produced by a sound producing device with the tactile feedback provided to the player.

11. A gaming system comprising:

a player chair comprising a player tactile feedback provider, the player tactile feedback provider comprising a transducer; and an electronic gaming machine associated with the player chair, the electronic gaming machine comprising:

a display device, a player eye tracker, a processor, and a memory device storing a plurality of instructions, which when executed by the processor, cause the processor to operate with:

the display device to display a selectable 3D object as part of a play of a game, the player eye tracker to determine whether a player has selected the selectable 3D object using the player's eyes, and responsive to the determination that the player has selected the selectable 3D object using the player's eyes, cause the player tactile feedback provider to provide a tactile feedback to the player as an acknowledgement of the player's selection of the selectable 3D object using the player's eyes within a designated period of time after the player's selection of the selectable 3D object using the player's eyes, wherein the tactile feedback is provided at a first level responsive to the player eye tracker detecting that the player's eyes pass over the selectable 3D object and the tactile feedback is provided at a second higher level responsive to the player eye tracker detecting that the player's eyes remain on the selectable 3D object for the designated period of time after the player's selection of the selectable 3D object using the player's eyes.

12. The gaming system of claim 11, wherein the plurality of instructions, when executed by the processor, cause the processor to control the transducer through an audio channel.

13. A method of operating a gaming system comprising an electronic gaming machine and a player chair, the method comprising:

causing the electronic gaming machine to display a plurality of selectable 3D images;

determining, by a player eye tracker, whether a player has selected one of the displayed selectable 3D images using the player's eyes; and responsive to the determination that the player has selected one of the displayed selectable 3D images using the player's eyes, cause a player tactile feedback provider of the player chair to provide a tactile feedback to the player based on that selected 3D image, wherein the player tactile feedback provider provides the tactile feedback at a first level responsive to the player eye tracker detecting that the player's eyes pass over any of the displayed selectable 3D images and the player tactile feedback provider provides the tactile feedback at a second higher level responsive to the player eye tracker detecting that the player's eyes remain on the player selected one of the displayed selectable 3D images for a designated time period.

14. The gaming system of claim 11, wherein the plurality of instructions, when executed by the processor, cause the processor to coordinate one or more sounds produced by a sound producing device with the tactile feedback provided to the player.

15. The method of claim 13, which comprises causing the tactile feedback to be based on the amount of time the player's eyes are fixed on the player selected one of the displayed selectable 3D images.

16. The method of claim 13, wherein different levels of tactile feedback are associated with the plurality of selectable 3D images.

17. The method of claim 13, wherein causing a player tactile feedback provider to provide tactile feedback to the player comprises causing a player contactor actuator of the player tactile feedback provider to actuate a player contactor of the player tactile feedback provider.

18. The method of claim 13, wherein the player tactile feedback provider comprises a transducer.

19. The method of claim 18, which comprises controlling one of an intensity and a pattern of the tactile feedback produced by the transducer through an audio channel.

20. The method of claim 13, which comprises coordinating one or more sounds produced by a sound producing device with the tactile feedback provided to the player.

* * * * *